United States Patent [19]

Koga et al.

[11] Patent Number: 4,981,269

[45] Date of Patent: Jan. 1, 1991

[54] VERTICAL MILL

[75] Inventors: Tadayuki Koga; Tatsuro Ishikawa; Keiichiro Miyazaki; Shinsuke Tanaka, all of Yamaguchi, Japan

[73] Assignee: Ube Industries, Ltd., Ube, Japan

[21] Appl. No.: 425,235

[22] Filed: Oct. 23, 1989

[30] Foreign Application Priority Data

Nov. 18, 1988 [JP] Japan ..... 63-290027
Dec. 27, 1988 [JP] Japan ..... 63-327712

[51] Int. Cl.[5] ..... B02C 15/00

[52] U.S. Cl. ..... 241/30; 241/37; 241/119; 241/121

[58] Field of Search ..... 241/117–121, 241/37, 30

[56] References Cited

U.S. PATENT DOCUMENTS

| | | | |
|---|---|---|---|
| 676,982 | 6/1901 | Erfurth | 241/119 |
| 2,475,814 | 7/1949 | Bruchsaler | 241/121 X |
| 4,372,496 | 2/1983 | Maliszewski | 241/37 |
| 4,485,974 | 12/1984 | Lass | 241/37 X |
| 4,489,895 | 12/1984 | Petersen | 241/119 X |

FOREIGN PATENT DOCUMENTS 147649 8/1984 Japan .

*Primary Examiner*—Mark Rosenbaum
*Attorney, Agent, or Firm*—Kanesaka and Takeuchi

[57] ABSTRACT

There is disclosed a vertical mill comprising a rotatable table and rotatable grinding rollers disposed on the upper surface of the table near the outer periphery of the table. Raw material is supplied to the central portion of the table. A given grinding pressure is applied to each grinding roller to crush the raw material between the upper surface of the table and the outer surface of each grinding roller. Rotatable auxiliary rollers are arranged alternately with the grinding rollers on the upper surface of the table near the outer periphery of the table. The layer of the material caught by the grinding rollers are compacted by the outer surfaces of the auxiliary rollers. There is also disclosed a method of operating the vertical mill. The method consists in separating controlling the grinding pressures applied to the grinding rollers according to the loads on the grinding rollers.

11 Claims, 9 Drawing Sheets

VERTICAL MILL

FIELD OF THE INVENTION

The present invention relates to a vertical mill in which a rotatable table cooperates with grinding rollers to pulverize raw materials such as limestone, slag, and cement materials. The invention also relates to a method of operating such a vertical mill.

BACKGROUND OF THE INVENTION

As shown in FIG. 6, a vertical mill 1 equipped with a rotatable table 3A and grinding rollers 4 has found extensive use as a mill for pulverizing limestone, raw material of cement, and other raw material into powder. The rotatable table 3A takes the form of a disk and is rotated at a low speed by an electric motor 2A via a reduction gear 2 below a cylindrical casing 15. The grinding rollers 4 are circumferentially spaced from each other on the upper surface of the table 3A near the outer periphery of the table and hydraulically or otherwise pressed against the upper surface. The rollers 4, therefore, follow rotation of the table 3A.

Each grinding roller 4 is connected to the piston rod 10 of a hydraulic cylinder 9 via arms 5 and 7. The arm 5 is mounted to the casing 15 by a shaft 6 so as to be swingable. The cylinder 9 is operated to press the rollers 4 against the rotatable table 3A. As a result, pressure is applied to the raw material, for pulverizing it. A dam ring 3B is formed at the outer fringe of the table 3A to adjust the thickness of the layer of the raw material. An annular space 14 is formed around the table 3A to permit gas to be ejected upward. A rotating separator 13 classifies the particles formed by pulverizing the raw material by blades 13A. The finished product is taken out through a discharge port 16, together with gas. The raw material enters into the mill through a chute 15B.

FIG. 7 shows another conventional vertical mill which is similar to the mill shown in FIG. 6 except that the chute 15B for introducing a raw material is inserted in the side surface of the casing 15.

The vertical mill shown in FIG. 7 is particularly shown in FIG. 8. The mill has four grinding rollers 4A–4D mounted on the rotatable table 3A and regularly spaced from each other circumferentially. Hydraulic cylinders 9A–9D are connected with the grinding rollers 4A–4D, respectively. A hydraulic system 16 has a single hydraulic pressure-adjusting device which supplies hydraulic force to chambers at the ends of the cylinders 9A–9D via pressure lines 17. The same pressure is applied to all the rollers 4A–4D to crush the raw material. Accumulators 19 are connected with the pressure lines 17.

In this vertical mill, the raw material is supplied to the central portion of the rotatable table 3 through the chute 15B. Two kinds of force are applied to the raw material on the table 3A. One kind is a circumferential force produced by rotation of the table 3A. The other is a centrifugal force produced by circumferential movement of the raw material that is subjected to the circumferential force. The radial force and the circumferential force are combined to cause the raw material to move toward the outer periphery of the table 3A while drawing a vortical orbit on the table 3A. Since the raw material slips on the upper surface of the table 3A, the peripheral speed of the material is slightly less than the rotational speed of the table 3A.

Because the rollers are pressed against the upper surface of the table 3A near the outer periphery and rotated, the raw material drawing a vortical orbit enters between one roller 4 and the table 3A at a certain angle to the axial direction of the roller and are crushed. Then, the crushed material is forced under the following roller and ground. In this way, the diameters of particles of the raw material gradually decrease.

Gas such as air or hot air stream is introduced into the base portion of the casing 15 through a duct. The gas flows upwardly through the annular space 14 between the outer periphery of the table 3A and the inner surface of the casing. The material pulverized on the upper surface of the table 3A is about to drop into the annular space 14 from the fringe of the table 3A, but the powder is carried by the gas and rises inside the casing 15. The powdered material is classified by the blades 13A of the separator 13 located at a high position in the mill. Finished product of a given grain size is discharged from the discharge port 16 together with the gas and sent to the next station. Particles of greater grain sizes which dropped into the annular space 14 from the fringe of the table 3A are collected. Subsequently, the large particles are returned onto the table 3A through the chute 15B.

In the aforementioned vertical mill, the rotating table 3A cooperates with the grinding rollers 4 to crush the raw material. Where the raw material tends to slip and behaves like fluid, supply of the material to the rollers may become intermittent, thus greatly deteriorating the crushing efficiency. Especially, where the crushed material contains a small percentage of moisture such as calcium carbonate or slag, the particles of the material behave like fluid and tend to slip on the rotatable table. Therefore, each individual particle tends to separate from each other. For this reason, the raw material which is supplied to the central portion of the table from the chute is moved to one grinding roller and again pressed against the table at a given hydraulic pressure. Then, the material is rummaged by the rollers to which crushing force is given and so the material tends to escape laterally. As a result, the proportion of the material which is not forced between any one roller and the table increases. Also, a mass of the raw material is supplied ahead of each roller, because the passage of the material is stopped. Such a mass is moved under one roller at a time. In this way, it is highly unlikely that the raw material is stably and continuously supplied to the pulverizing rollers. After the raw material is sandwiched between one roller and the table and passes through this space, the material is suddenly released from the pressure. Therefore, the material pops up from the gap between the roller and the table. Consequently, the particles of the material become separate, thus forming an uncompacted layer. As such, the raw material may arrive at the next grinding roller without forming a stable layer. The result is that a sufficient amount of material is not supplied to the rollers. Hence, the pulverizing efficiency is very low.

In the vertical mill which pulverizes raw material between the rotating table and each grinding roller, the amount of material caught by each grinding roller and the size of the caught particles differ among the rollers, according to the condition of the particles of the material on the table. The loads on the rollers may differ. These differences are affected by the water content, the gain size, and other properties of the pulverized raw material. In this case, if the material is crushed by applying the same pressure to all the grinding rollers, overgrinding tends to occur, or it is difficult to fabricate products of a given grain size stably. Therefore, an excessive amount of power is consumed, or the mill produces vibration. This hinders stable operation of the mill. Especially, where slag or finished cement is crushed, the grain size distribution is required to be stable, because it is the final product.

The present applicant has already proposed a method of preventing overgrinding and reducing the amount of consumed power in Japanese Patent Laid-Open No. 147,649/1984. In this method, one set of two symmetrically arranged grinding rollers is controlled by a hydraulic controller. Specifically, their pulverizing pressure is controlled. Also, a second set of two symmetrically arranged grinding rollers is controlled by another hydraulic controller. The pulverizing pressures applied to two symmetrically arranged rollers of each set are the same and so this method cannot cope with the case where different loads are placed on the several rollers, for example four rollers. Hence, this method still cannot prevent overgrinding. Also, neither stabilization of the distribution of grain sizes of the finished product nor stable operation producing less vibration can be attained.

SUMMARY OF THE INVENTION

It is an object of the present invention to provide a vertical mill that compacts a layer of a raw material to prevent the particles of the material from separating and improves the efficiency at which the material is caught by grinding rollers, whereby enhancing the grinding efficiency of the mill.

It is another object of the invention to provide a method of operating a vertical mill in such a way as to give separate appropriate pressures to grinding rollers even if the loads on the rollers are different, for fabricating products of good quality and assuring stable operation.

The first-mentioned object is achieved in accordance with the invention by a vertical mill comprising grinding rollers, a rotatable table, and rotatable auxiliary rollers which compact the layer of raw material by their outer surfaces, the layer being supplied to the grinding rollers, the auxiliary rollers being arranged alternately with the successive grinding rollers on the upper surface of the table near the outer periphery of the table. The auxiliary rollers are close to the positions at which the material is caught by the grinding rollers.

The auxiliary rollers are arranged midway between the successive grinding rollers on the upper surface of the table near the outer periphery of the table.

After raw material is supplied onto the upper surface of the central portion of the rotatable table from a material-introducing chute, the material moves toward the outer periphery of the table while drawing a vortical orbit on the table. Then, the material reaches a position at which it is caught by one auxiliary roller, and the material enters between the auxiliary roller and the table. The outer surface of the auxiliary roller which is rotating is lightly pressed against the material with a given force to compress the material. Then, the material forms a flat, dense compacted layer. This layer passes under the auxiliary roller and is brought by rotation of the table into a position at which it is caught by one grinding roller. Although the grinding roller is pressed against the table with a large force, the compacted layer is caught by the grinding roller with a higher probability and crushed continuously. The material pulverized by the grinding roller is discharged from the exit side of the roller and forms an uncompacted layer consisting of separate particles of the material. The uncompacted layer is similarly compacted by the following auxiliary roller to form a compacted layer. This compacted layer is substantially seized by the following grinding roller and pulverized efficiently. Since the force of each auxiliary roller acting toward the upper surface of the table does not contribute to pulverization, the force is so set that particles of the raw material are compacted together to thereby form a compacted layer. Hence, this force is much smaller than the force exerted by each grinding roller.

The novel vertical mill is especially adapted for the case in which raw material tending to slip on the rotatable table, or behaving like fluid, or raw material having a low water content is crushed.

The auxiliary rollers are disposed close to the entrance sides of the grinding rollers. Therefore, new raw material which is forced from the chute toward the outer periphery of the table does not readily enter the entrance sides of the auxiliary rollers. This increases the ratio of the material which enters the entrance sides of the auxiliary rollers. For this reason, the compacted layer of particles of the material which is created by the auxiliary roller is not easily disturbed by the aforementioned new raw material. This ensures that the material is seized by the grinding rollers. Of course, the new material is added to the material pulverized by the previous grinding roller. The mixture is compacted by the auxiliary roller.

When each auxiliary roller is disposed midway between successive grinding rollers, the auxiliary roller can be placed close to the exit side of the grinding roller and so the material crushed by the grinding roller located rearwardly of the auxiliary roller as viewed in the direction of rotation of the rotatable table is surely compacted. In this case, the grinding rollers and the auxiliary rollers are angularly regularly spaced from each other circumferentially of the table. This makes it easy to design and fabricate the mill.

In another aspect of the invention, the pressure applied to each individual grinding roller for pulverizing the material is separately controlled according to the load imposed on each individual grinding roller.

In the operation of the novel vertical mill, the actual values of the pressures applied to the grinding rollers for pulverizing the raw material are detected. The pressures are reset or modified according to the detected values. The present invention is characterized in that the pressure applied to the grinding roller located at the position at which the introduced raw material is most easily seized is made maximum, and that the pressures applied to the grinding rollers located forwardly of that grinding roller as viewed in the direction of rotation of the table are made to decrease successively.

In these aspects, the grinding pressures applied to the grinding rollers are separately controlled according to the loads on the grinding rollers and so the grinding work is evenly distributed among the grinding rollers. The raw material is uniformly pulverized. This prevents overgrinding and stabilizes the distribution of the grain sizes of the finished product. Because the material is evenly caught by every grinding roller and crushed by the same pressure applied by all the grinding rollers, the mill does not produce abnormal vibration. Hence, the mill runs stably. Further, excessive consumption of power can be avoided. The amount of the raw material caught by each grinding roller changes, depending on changes in the amount of raw material pulverized by the mill and on changes in the properties of the raw material. This varies the loads imposed on the grinding rollers. According to the load changed, the operated grinding rollers are freely selected out of all the grinding rollers. Also, the pressures applied to the grinding rollers can be set to desired values. Adjustments can be easily made to maintain a desired distribution of grain sizes and to operate the mill stably.

If the mill is so operated that the actual pressures applied by the grinding rollers are detected, the loads on the grinding rollers are monitored, and the pressures applied to the grinding rollers are modified according to the actual loads. Then the mill is operated under optimum conditions according to changes in the loads on the grinding rollers, the changes being caused by changes in the properties of the raw material. Consequently, the mill can be run more stably.

Considering the fluidity of the raw material that varies according to the position at which it is introduced, the pressure applied by the grinding roller located at the position at which the material is most easily caught is made greatest. That is, this grinding roller pulverizes the greatest portion of the material. The pressures applied by the grinding rollers decrease gradually toward the forward direction of rotation of the table. The pulverization work is evenly distributed among the grinding rollers. This ensures more stable operation.

DETAILED DESCRIPTION OF THE INVENTION

Figure 1A:
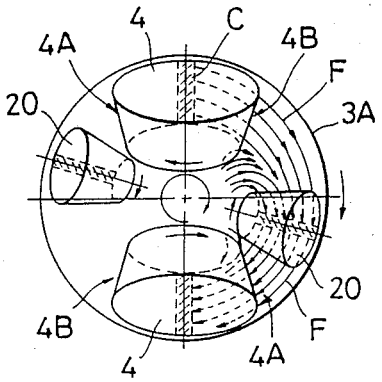
FIG. 1A is a plan view of grinding rollers and auxiliary rollers, for showing their arrangement.
Figure 1B:
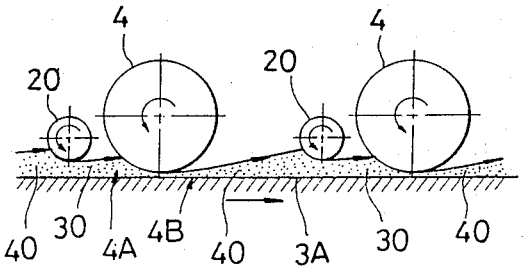
FIG. 1B is an expanded front elevation view of the rollers shown in FIG. 1A.
Figure 2:
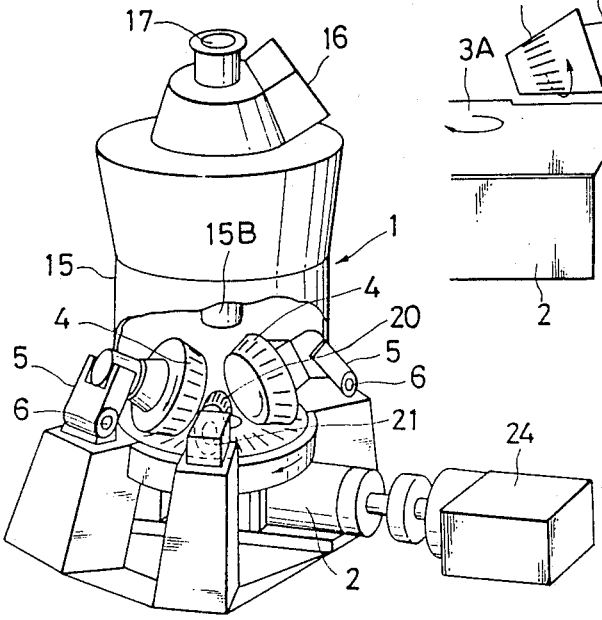
FIG. 2 is a perspective view of a mill according to the invention.
Figure 3:
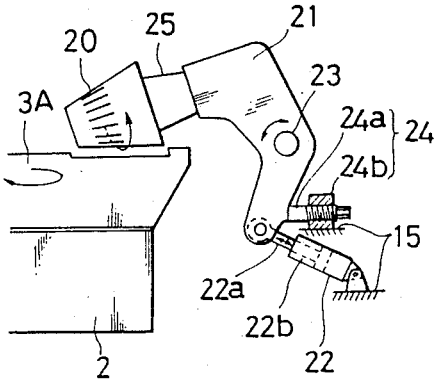
FIG. 3 is a side elevation view of a portion where one auxiliary roller is mounted.

Referring to FIGS. 1-3, there is shown a vertical mill according to the invention. It is to be noted that like components are denoted by like reference numerals in various figures.

As shown in FIGS. 1 and 2, two grinding rollers 4 are disposed in a symmetrical relation with respect to the center of a rotatable table 3A on the upper surface of the table. The rollers 4 are located close to the outer periphery of the table 3A. Auxiliary rollers 20 having a smaller diameter than that of the grinding rollers 4 are disposed on the upper surface of the table 3A between the grinding rollers 4. The auxiliary rollers 20 are located close to the positions 4A at which raw material is caught by their respective grinding rollers 4.

As shown also in FIG. 3, each auxiliary roller 20 is rotatably mounted to a shaft 25 which is fixed to the front end of a substantially U-shaped arm 21. This arm 21 is rotatably held to a casing 15 by a shaft 23. A hydraulic cylinder 22 has a piston rod 22*a* which is connected to, and supported by, the lower end of the arm 21. A certain hydraulic pressure is caused to act on the chamber 22*b* in the hydraulic cylinder 22 by the piston rod 22*a*, for compacting the layer of the raw material. The end of the cylinder 22 which is on the opposite side of the piston rod 22*a* is rotatably held to the casing 15. The compacting force is adjusted hydraulically by a pressure-adjusting valve (not shown) mounted in a hydraulic line connected with the cylinder chamber 22*b* of the hydraulic cylinder 22. An accumulator is connected with this hydraulic line to maintain the pressure inside the cylinder chamber 22*b* constant. The piston rod 22*a* of the hydraulic cylinder 22 is caused to expand and contract, for rotating the arm 21 about the shaft 23. Thus, the auxiliary roller 20 is moved up and down.

A gap adjuster 24 is mounted below the arm 21 to adjust the gap between the auxiliary roller 20 and the upper surface of the rotatable table 3A. The adjuster 24 is rigidly fixed to the casing 15, and consists of a base 24*b* and a threaded shaft 24*a*. The base 24*b* is provided with a tapped hole into which the threaded shaft 24*a* is screwed. The front end of the shaft 24*a* bears on one side of the arm 21 to permit the gap between the auxiliary or pregrinding roller 20 and the upper surface of the table 3A to be set. If the weight of the auxiliary roller 20 itself is sufficient to compact the layer of the raw material, the hydraulic cylinder 22 is not operated. A spring may be applied instead of the hydraulic cylinder 22. The pregrinding rollers 20 grind the material preliminarily before it is pulverized by the rollers 4.

The operation of the vertical mill constructed as described above is now described. Raw material is supplied onto the upper surface of the central portion of the rotatable table 3A from a material-introducing chute 15B and caused to draw a vortical orbit on the table 3A and move toward the outer periphery of the table by the rotating force of the table. As shown in FIG. 1(B), most of the raw material and the powder already made by the grinding rollers 4 form an uncompacted layer 40, which enters between each auxiliary roller 20 and the upper surface of the rotatable table 3A. The auxiliary rollers 20 rotate while slightly raised by the layer of the raw material. The uncompacted layer 40 is compressed between the outer surface of each auxiliary roller 20 and the upper surface of the table 3A to form a compacted layer 30. As the table 3A rotates, the compacted layer 30 reaches the position 4A at which it is caught by one grinding roller 4. In the compacted layer, the particles of the raw material do not separate from each other but are compacted together. Therefore, the compacted layer 30 is securely seized by the grinding roller 4. In other words, the raw material is not swept away but caught by the grinding roller 4. The proportion of the material which passes by the roller like fluid is low. This enhances the grinding efficiency. In FIG. 1(A), the orbit that the particles of the raw material follow is indicated by F. The material is caught and pulverized in the portion C between one roller and the table 3A. Only the right half of the orbit is shown in the figure.

The hydraulic pressure created by the hydraulic cylinder 22 is so adjusted that the force applied to the auxiliary roller 20 is large enough to compact the particles of the raw material of the particles but insufficient to pulverize the material. The force applied by the auxiliary roller 20 is so determined that the auxiliary roller 20 is slightly raised from the height limited by the threaded shaft 24*a* when the raw material is held between the auxiliary roller 20 and the table 3A. The force applied by the auxiliary roller 20 can be made much smaller than the pushing, or pulverizing force of the grinding roller 4. If the weight of the roller itself suffices, then it is not necessary to supply hydraulic force. The force applied to the material by the auxiliary roller varies, depending on the size of the particles of the material and the amount of water adhering to the particles. For example, if the particle size is small, the force applied to the material is made small.

After the raw material is caught and pulverized by the grinding roller 4, the material undergoes a compressive force in the narrow gap between the grinding roller 4 and the table 3A. Under this condition, the material is subjected to rotating force of the table 3A and the grinding roller 4. The particles pop up from the exit side 4B of the grinding roller 4 and become separated from each other. The new material supplied from the introducing chute 15B is added to these particles to form the uncompacted layer 40. This uncompacted layer 40 is compacted by the following auxiliary roller 20 in the same way as in the above process. Then, the layer is seized by the grinding roller 4 located forwardly of the table 3A as viewed in the direction of rotation and crushed. The grain size approaches the grain size of the finished product. Since the auxiliary roller 20 is located close to the entrance side 4A of the grinding roller 4, only a small percentage of the new material supplied onto a table 3A from the introducing chute 15B is added to the compacted layer 30 and, therefore, the compacted condition is less likely to be disturbed. In this way, the stable compacted layer 30 is certainly caught by the grinding roller 4. In this example, the diameter of the auxiliary rollers is smaller than the diameter of the grinding rollers 4. Generally, when the diameters of the raw material particles are small, the diameter of the auxiliary rollers 20 can be small. Conversely, when the particle diameters are larger, the diameter of the auxiliary rollers are made large. Thus, the layer of the particles is compacted according to the diameters of the particles.

The space between the auxiliary roller 20 and the upper surface of the rotatable table 3A is set by moving the threaded shaft 24*a* of the gap adjuster 24 forward or rearward. When the diameters of the raw material particles are large, the space is increased. When the diameters of the particles are small, the space is reduced. Since this space is made to compact the layer of the particles, if the space is too small, the layer will be disturbed. Also, in order that the layer be smoothly caught by the auxiliary roller 20, if the diameters of the raw material are less than 5 mm and the space between the grinding roller 4 and the rotatable table 3A is as large as 5 to 10 mm, the space between the auxiliary roller 20 and the table 3A is set to 40 to 60 mm.

Figure 4A:
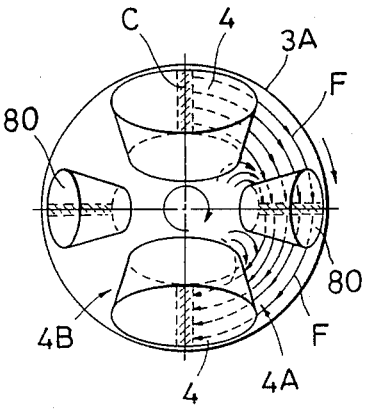
FIG. 4A is a plan view of grinding rollers and auxiliary rollers, for showing their arrangement different from the arrangement shown in FIG. 1A.
Figure 4B:
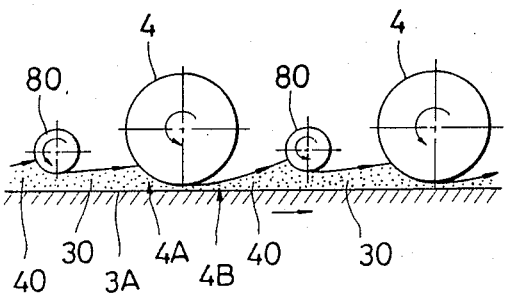
FIG. 4B is an expanded front elevation view of the rollers shown in FIG. 4A.

Another vertical mill according to the invention is shown in FIGS. 4(A) and 4(B). In this example, auxiliary rollers 80 have a smaller diameter than grinding rollers 4 in the same way as in the above-described example. The auxiliary rollers 80 are disposed on the upper surface of a rotatable table 3A between successive grinding rollers 4 near the outer periphery of the table 3A. The auxiliary rollers 80 are placed closer to the discharge sides 4B of the grinding rollers 4 than in the first-mentioned example. Therefore, the raw material is pulverized by the grinding roller 4 and discharged from the discharge sides 4B as an uncompacted layer 40. This uncompacted layer 40 is compacted effectively. Of course, some of the new raw material supplied from a material-introducing chute 15B is fed to the auxiliary rollers 80 and compacted. In this example, since the distance between each auxiliary roller 50 and the adjacent grinding rollers 4 as measured along the upper surface of the table 3A is long, the supply of the new raw material tends to disturb the layer 30 compacted by the auxiliary rollers 80. In this case, since the layer of the particles of the raw material pulverized by the grinding rollers 4 and discharged from their discharge sides 4B are compacted effectively, raw materials which can be easily pulverized and fly off are effectively crushed. In this example, th grinding rollers 4 and the auxiliary rollers 80 are regularly spaced from each other. This makes it easy to fabricate the mill. If the auxiliary rollers are placed closer to the discharge sides 4B of the grinding rollers 4, then the raw material pulverized by the grinding roller 4 is compacted more effectively and then supplied to the next grinding roller 4.

Figure 5A:
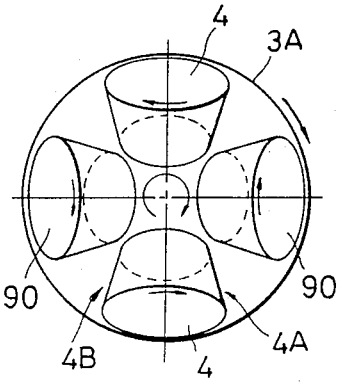
FIG. 5A is a plan view of grinding rollers and auxiliary rollers, for showing their arrangement different from the arrangements shown in FIGS. 1A and 4A.
Figure 5B:
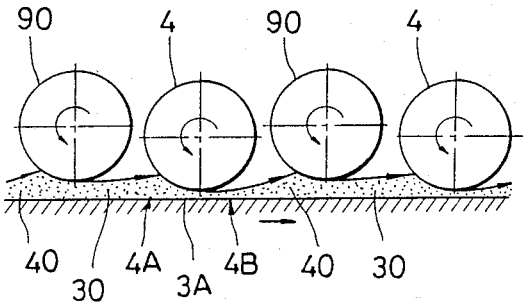
FIG. 5B is an expanded front elevation view of the rollers shown in FIG. 5A.

FIGS. 5(A) and 5(B) show a vertical mill which is similar to the mill shown in FIGS. 4(A) and 4(B) except that the auxiliary rollers 80 are replaced by auxiliary rollers 90 which are identical in diameter of the grinding rollers 4. This example yields the same advantages of the previous example shown in FIGS. 4(A) and 4(B). Furthermore, it effectively compresses larger particles of raw material, since the auxiliary rollers 90 are large. In addition, since the weight of each auxiliary roller 90 itself is large, hydraulic pressure from the external hydraulic cylinder 22 is hardly needed, or the cylinder 22 is not necessary. In the latter case, the raw material can be compacted by the weight of each auxiliary roller itself. If the auxiliary rollers are made equal in diameter to the grinding rollers 4, then all the rollers are rendered identical. That is, every roller can be replaced with each other. This is advantageous to maintenance of the machine and manufacture.

Figure 6:
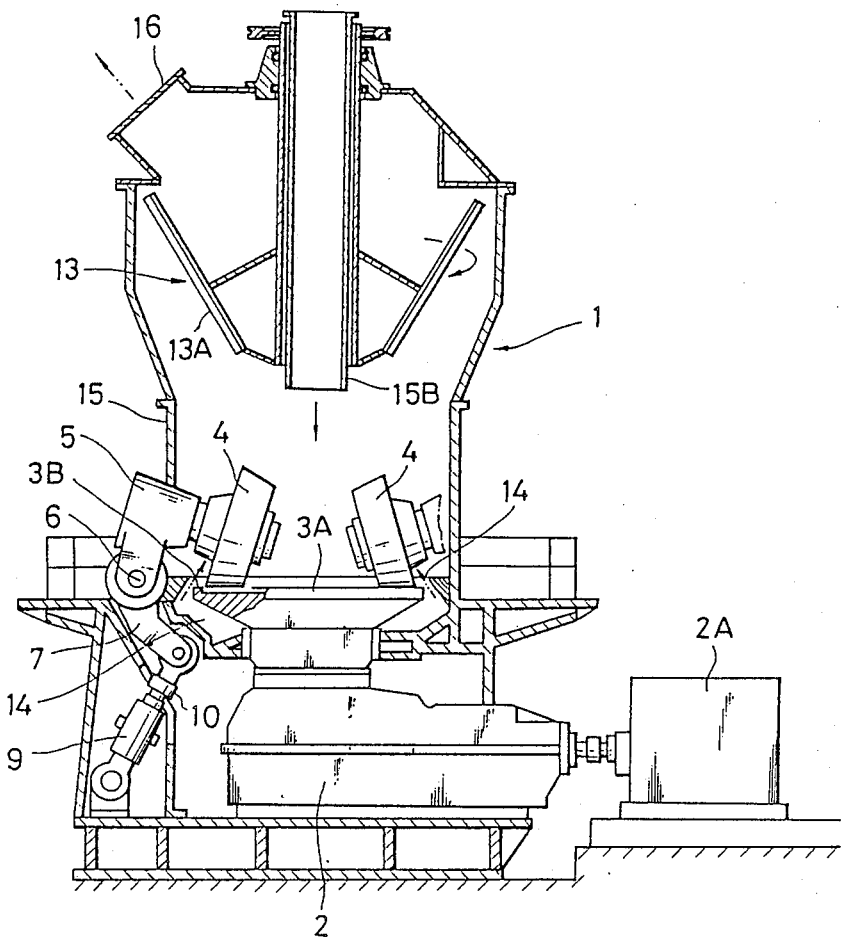
FIG. 6 is a vertical cross section view of the prior art vertical mill.
Figure 7:
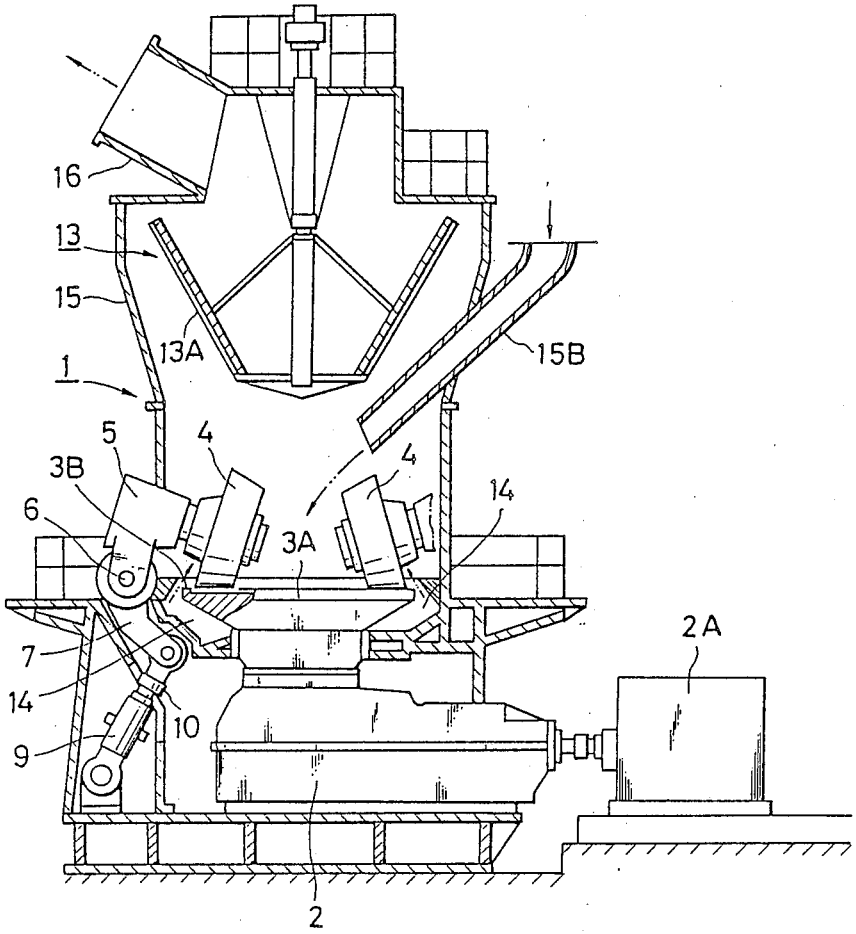
FIG. 7 is a vertical cross section view of the vertical mill shown in FIG. 6.
Figure 8:
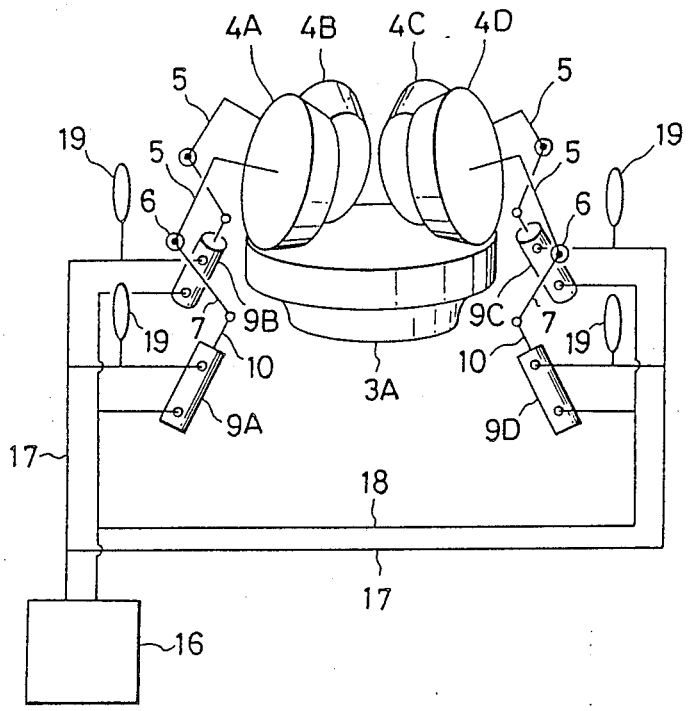
FIG. 8 is a diagram of the hydraulic lines of the mill shown in FIGS. 6 and 7.
Figure 9:
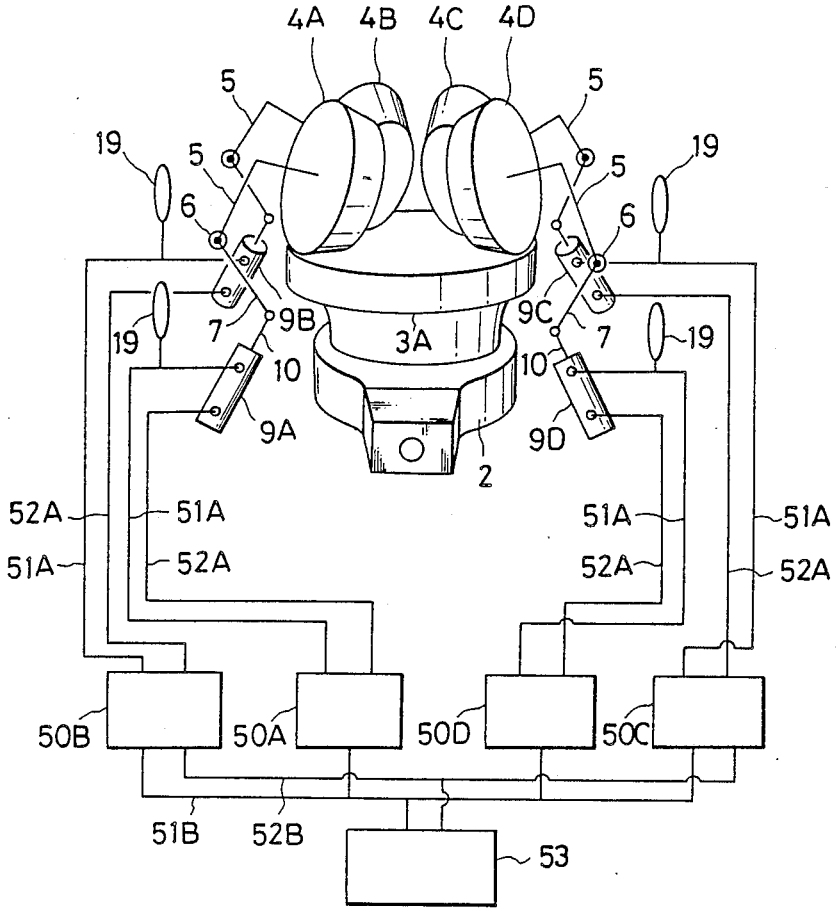
FIG. 9 is a diagram of grinding rollers and hydraulic lines.
Figure 10:
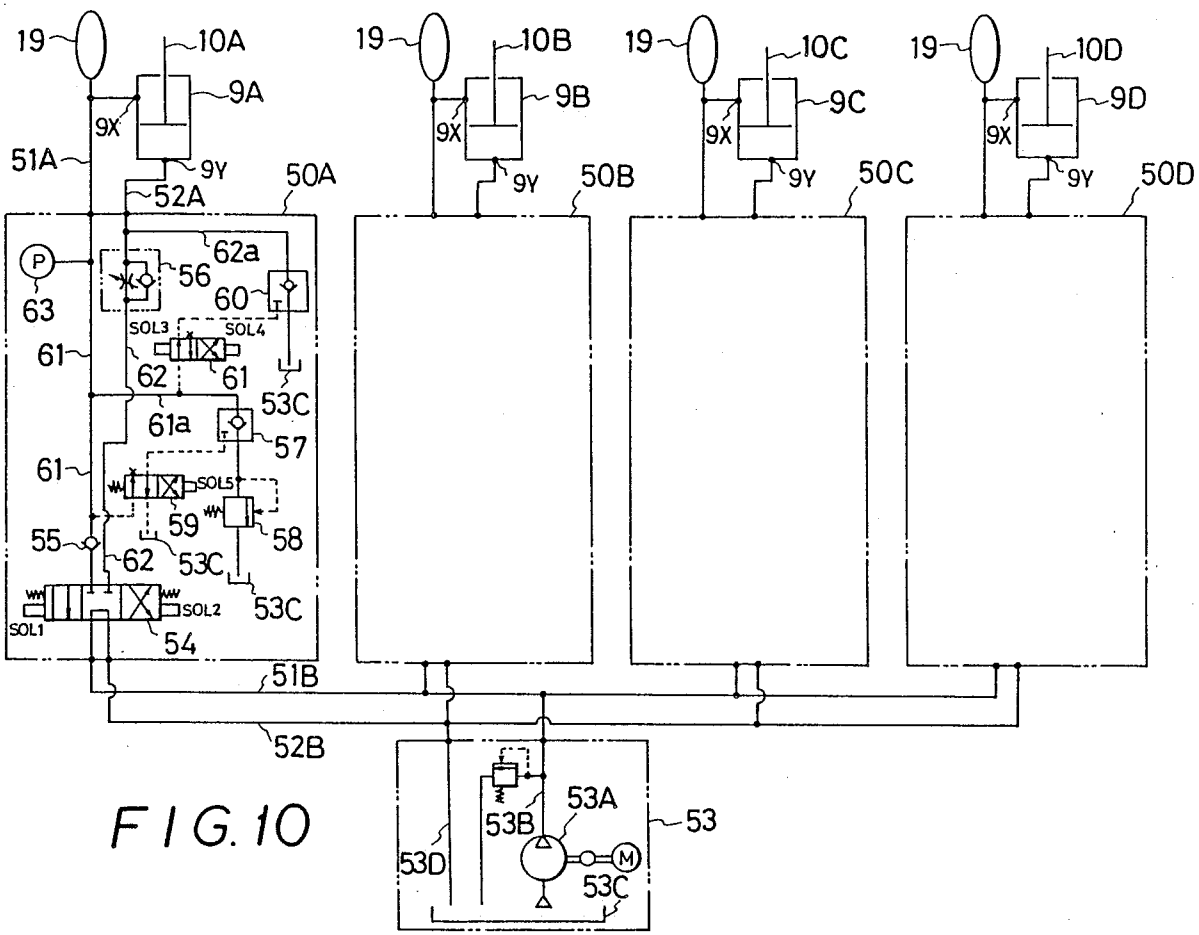
FIG. 10 is a diagram of hydraulic control units, hydraulic pump units, and hydraulic cylinders, for showing their connection.

FIGS. 9 and 10 show an apparatus according to the invention. FIG. 9 shows the arrangement of grinding rollers and hydraulic lines. FIG. 10 shows the connection of hydraulic control units, hydraulic pump units, and hydraulic cylinders. It is to be noted that like components are indicated by like reference numerals in various figures and that those components which have been already described in connection with FIGS. 6 and 7 will not be described below.

As shown in FIG. 9, four grinding rollers 4A–4D are circumferentially equally spaced from each other on the rotatable table 3A. Hydraulic cylinders 9A–9D are mounted on the grinding rollers 4A–4D, respectively. Hydraulic control units 50A–50D are connected with the hydraulic cylinders 9A–9D, respectively, via tubes 51A and 52A. Hydraulic pressure is distributed to the hydraulic control units 50A–50D by a single hydraulic pump unit 53 via tubes 51B and 52B.

FIG. 10 particularly shows the circuits of the hydraulic control units 50A–50D. Since all the hydraulic control units are identical in configuration, only the hydraulic control unit for only one grinding roller is shown.

A solenoid selector valve 54 has a pump side to which a tube 51B is connected and a tank side to which a tube 52B is connected. The hydraulic pump unit 53 has a pump 53A including a discharge tube 53B to which the tube 51B is connected. The tube 52B is connected with a tube 53D going back to a tank 53C. A tube 51A is connected with one side of the selector valve 54 via a tube 61. The tube 51A is connected with an oil supply port 9X of a chamber formed in the hydraulic chamber 9A. A tube 52A is connected to the valve 54 via a tube 62 and also to an oil supply port 9Y at the end of the chamber in the hydraulic cylinder 9A.

When a solenoid SOL1 of the solenoid selector valve 54 is energized, oil forced from the pump 53A passes through the tubes 53B and 51B, the selector valve 54, the tubes 61, 51A, the oil supply port 9X, and is supplied into the chamber in the hydraulic cylinder 9A. Then, pressure is applied to the grinding roller 4A to pulverize the raw material. An accumulator 19 is connected with the tube 51A to maintain the pressure constant. Indicated by numeral 55 is a check valve. A pressure-adjusting valve 58 is mounted to a tube 61*a* via a pilot check valve 57, the tube 61*a* branching off from the tube 61. The pulverizing pressure applied to the grinding roller 4A is adjusted or set by the pressure-adjusting valve 58 which can be automatically controlled by using a solenoid valve as the valve 58. The pilot check valve 57 is operated by a solenoid selector valve 59. The valve 59 energizes its solenoid SOL5 to open the pilot check valve 57, for adjusting or setting the hydraulic pressure determined by the pressure-adjusting valve 58.

When a solenoid SOL2 of the solenoid selector valve 54 is energized, the oil delivered from the pump 53A passes through the tubes 53B and 51B, the solenoid selector valve 54, the tubes 62, 52A, the oil supply port 9Y, and then reaches the chamber in the hydraulic chamber 9A. This raises the grinding roller 4A. A pilot check valve 60 is mounted to a tube 62*a* branching off from the tube 62. This check valve 60 is opened and closed by operating solenoids SOL3 and SOL4 of the solenoid selector valve 61.

During pulverization, the solenoid SOL3 of the solenoid selector valve 61 is energized to create the illustrated condition. The pilot pressure from the tube 61 of the grinding pressure line opens the pilot check valve 60 to place the chamber in the hydraulic cylinder 9A into communication with the tank 53C. The solenoid selector valve 59 is maintained in the illustrated condition and the pilot check valve 57 is closed. As a result, a certain grinding pressure is retained inside the tubes 61, 51A, the accumulator 19, and the chamber in the hydraulic cylinder 9A.

When the grinding roller 4A is elevated as encountered when the work is stopped, the solenoid SOL4 of the solenoid selector valve 61 is energized to close the pilot check valve 60. A flow control valve 56 is mounted in the tube 62.

In this example, the grinding pressures applied to the four grinding rollers 4A–4D are separately controlled. Each grinding pressure is controlled according to the load on the corresponding grinding roller.

Figure 11:
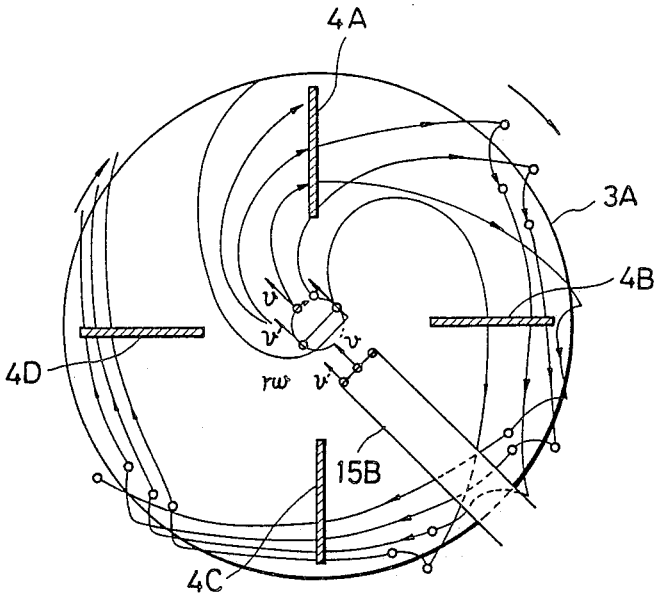
FIG. 11 is a diagram illustrating the behavior of raw material on a rotating table.
Figure 12:
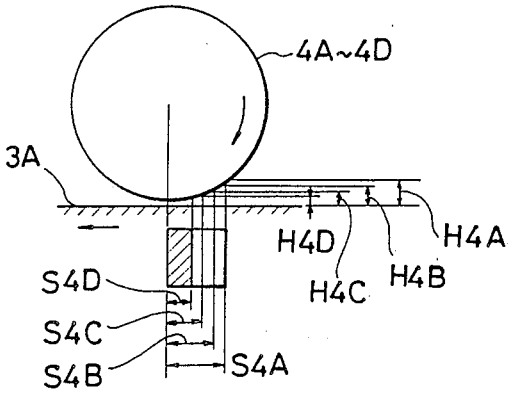
FIG. 12 is a diagram illustrating various amounts of raw material caught by various grinding rollers.

Referring to FIG. 11, when the material-introducing chute 15B is mounted obliquely and raw material is supplied onto the rotating table 3A, the material tends to behave like fluid on the table 3A as shown. Specifically, the grinding roller 9A located at the position at which the material is most easily caught must grind the maximum amount of raw material, i.e., the highest load is imposed on this grinding roller. The loads on the grinding rollers 9B, 9C, 9D which are located successively forwardly of the grinding roller 9A as viewed in the direction of rotation of the table 3A decrease in this order. Some of the raw material caught by the first grinding roller 9A is conveyed upward and recovered as the final product by air which is ejected upward after passing through the gas supply passage 14 from the outer periphery of the table 3A, before the material reaches the next grinding roller 9B. The amount of material caught by the grinding roller 9B is less than the amount of material caught by the grinding roller 9A. Similarly, the amounts of material seized by the grinding rollers 9C and 9D decrease successively. The raw material is successively caught by the grinding rollers 9A–9D and repeatedly pulverized by these rollers while it is being moved in the forward direction of the table 3A. During this process, the grain size decreases. Finally, the finished product of the given grain size is obtained. As illustrated in FIG. 12, the amounts of raw material caught by the grinding rollers 9A–9D decrease successively. Since the sizes of the particles of the caught raw material decrease gradually, the thicknesses H4A–H4D of the layers of the raw material seized by the grinding rollers decrease successively. Also, the areas S4A–S4D with which the grinding rollers come into contact with the raw material decrease successively.

In the prior art method, all the grinding rollers 9A–9D exert the same pressure or opposite grinding rollers apply the same pressure. Therefore, the raw material is not crushed uniformly by the individual grinding rollers, thus resulting in overgrinding. For this reason, the distribution of grain sizes is not stable, or excessively high grinding pressure produces abnormal vibration.

In accordance with the present invention, as indicated by O in Table 1, the grinding pressure applied to the grinding roller 9A on which the maximum grinding load is imposed is made highest. The pressures applied to the grinding rollers 9B–9D located forwardly of the roller 9A as viewed in the direction of rotation of the table 3A are made to decrease successively. Grinding pressures matched to the grinding rollers are given to them. Hence, the raw material is well pulverized.

TABLE 1

| | Rollers | | | |
|---|---|---|---|---|
| Pressure | 4 A | 4 B | 4 C | 4 D |
| High | | | | |
| Middle | □ | | | |
| Low Middle | | □ | | |
| Low | | | □ | |
| Zero | | | | □ |

When the pressures to the grinding rollers are set in this way, the actual loads on the grinding rollers 4A–4D are monitored with a pressure gauge 63 shown in FIG. 10 during the operation of the mill. The pressures of the grinding rollers 4A–4D are modified according to the actual loads. This makes the pulverizing operation more reliable. In particular, if the reading of the pressure gauge 63 is high, or if the pointer moves frequently, then it follows that the grinding roller pulverizes a large amount of raw material. If the reading is low, or if the pointer moves infrequently, then the grinding roller crushes a small amount of raw material. The optimum grinding pressure according to the load is realized according to the amount of raw material pulverized. The particles of the raw material behave like fluid on the table 3A, and this behavior varies according to various factors, e.g., the water content of the actually introduced raw material, the properties such as grain size, the manner in which the material-introducing chute is mounted, the amount of gas ejected from the gas supply passage 14, and the height of the dam ring 3B. Depending on the loads on the grinding rollers which are varied by the variation of the aforementioned behavior, the grinding pressures applied to the grinding rollers are modified. This makes the pulverization more reliable. If the water content of the raw material is high, the frictional resistance that the raw material particles receive from the rotating table 3A increases. In this state the particles are more affected by the rotation of the table 3A and tend to rotate on the table. The amount of the material moved to the outside of the table decreases and the amount of the material caught by the grinding roller increases, thus increasing the pulverizing load. This tendency also occurs where the diameters of the particles of the raw material are large, because the frictional resistance with the table 3A increases. Accordingly, depending on the changes in the loads caused by the properties of the raw material, the grinding pressure is determined.

In accordance with the present invention, the grinding pressures applied to the grinding rollers can be separately adjusted and so the mill can easily cope with the case in which the load on the mill is changed as indicated by □ in Table 1. As an example, when the load is decreased from a high load to a middle load, the grinding pressures applied to the grinding rollers 9A, 9B, 9C are set to a middle pressure, a low middle pressure, and a low pressure, respectively. The grinding pressure applied to the grinding roller 9D is set to zero. In this way, the grinding pressures are set according to the loads imposed on the grinding rollers.

Where the raw material is supplied to the central portion of the rotatable table 3A from just above it so that the raw material may be substantially evenly caught by the grinding rollers, the loads on the grinding rollers are substantially the same. Even in this case, the grinding pressures applied to the grinding rollers can be made substantially equal. Of course, it is easy to maintain the grinding pressures applied to the two opposite grinding rollers 9A and 9C constant, irrespective of changes in the amount of the caught material and in the load on the mill. A pressure different from the above pressure can be applied to the two other opposite grinding rollers 9B and 9D according to a different load. This pressure can be set to zero.

Figure 13:
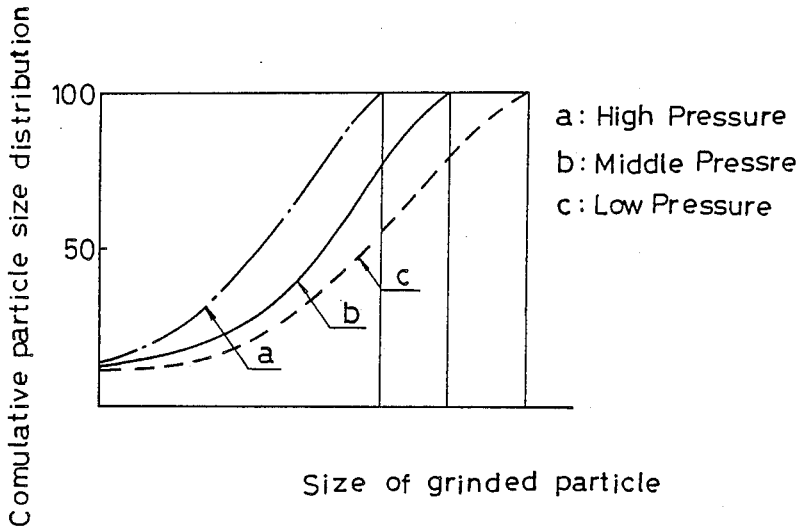
FIG. 13 is a graph showing the changes in the distribution of the grain sizes when grinding pressure is changed.

As shown in FIG. 13, the distribution of the grain sizes of the finished product can be easily adjusted by separately adjusting the grinding pressures applied to the grinding rollers, and the distribution can be made stable. In the graph of FIG. 13, curves a, b, c show the distributions of grain sizes when the grinding pressure is set to a high value, a middle value, and a low value, respectively.

In the description made above, the grinding rollers are four in number. The invention can also be applied to a mill having two, three, or more grinding rollers. Of course, the invention is applicable to the mills shown in FIGS. 1–5.

What is claimed is:

1. A vertical mill comprising:

a rotatable table having an upper surface, means for rotating the rotatable table, a plurality of grinding rollers situated above the rotatable table and having outer surfaces respectively, said grinding rollers pulverizing raw materials between the outer surfaces of the grinding rollers and the upper surface of the rotatable table, a plurality of auxiliary rollers situated above the rotatable table to be arranged alternately with the grinding rollers, each auxiliary roller having an outer surface in a conical shape with top and bottom portions and being arranged such that the top portion orients toward a center of the rotatable table, distance between the upper surface of the rotatale table and the outer surface of the auxiliary roller adjacent the rotatable table being substantially constant and larger than distance between the upper surface of rotatable table and the outer surface of each grinding roller, each auxiliary roller compacting the raw materials in the pre-compressed condition between the outer surface of the auxiliary roller and the rotatable table before the raw materials are supplied to the grinding roller so that the raw materials can be surely and constantly supplied to the grinding roller for grinding, and means for supplying raw materials on the rotatable table for pulverization by means of the grinding rollers.

2. A vertical mill according to claim 1, further comprising a casing surrounding the rotatable table and having a space for ejecting a gas upwardly around the rotatable table.

3. A vertical mill according to claim 1, further comprising means for adjusting space of the auxiliary rollers relative to the upper surface of the rotatable table.

4. A vertical mill according to claim 3, wherein each auxiliary roller includes an arm for rotationally supporting the auxiliary roller and a casing for pivotally supporting the arm, each space adjusting means including a base fixed to the casing and a threaded shaft connected to the arm and engaging the base, the space between the auxiliary roller and the upper surface of the rotatable table being adjusted by regulating the threaded shaft and the base.

5. A vertical mill according to claim 3, further comprising means for applying pressure to the respective auxiliary rollers, said pressure applying means pressing the auxiliary roller relative to the upper surface of the rotatable table when the distance between the upper surface of the rotatable table and the outer surface of the auxiliary roller exceeds the predetermined value.

6. A vertical mill according to claim 1, wherein said means for supplying raw materials incudes a chute situated obliquely above the upper surface of the rotatable table so that the raw materials are supplied onto the rotatable table at one side thereof.

7. A vertical mill according to claim 6, wherein said grinding rollers are pressurized onto the rotatable table, grinding pressure applied to the grinding rollers being different so that the grinding roller for initially grinding the raw materials is pressurized highest, and the grinding pressures for the following grinding rollers decrease successively.

8. The vertical mill of claim 1, wherein the auxiliary rollers are mounted on the upper surface of the rotatable table near the outer periphery of the table and disposed close to the positions at which the raw material is caught by the grinding rollers.

9. The vertical mill of claim 1, wherein the auxiliary rollers are disposed midway between the successive grinding rollers on the upper surface of the rotatable table near the outer periphery off the table.

10. A method of operating a vertical mill having a rotatable table, grinding rollers and auxiliary rollers, said method comprising, supplying raw materials onto the rotatable table at one side thereof, said rotatable table rotating about an axis thereof, pressurizing the grinding rollers onto the rotatable table for pulverizing the raw materials on the rotatable table by means of the grinding rollers pressed against the rotatable table, detecting actual values of the grinding pressures applied by the grinding rollers during operation of the mill, modifying the grinding pressures applied to the grinding rollers according to the detected values, wherein the grinding pressure applied to the grinding roller where the raw materials are at first supplied is made maximum, and the grinding pressures applied to the following grinding rollers are gradually reduced as the raw materials are ground.

11. A method of operating a vertical mill according to claim 10, wherein said auxiliary rollers are situated between two adjacent grinding rollers, said auxiliary rollers compressing the raw materials before the raw materials are supplied to the grinding rollers so that the raw materials can be surely and constantly supplied to the grinding rollers.

* * * * *